US008690384B2

(12) United States Patent
Hochstein

(10) Patent No.: US 8,690,384 B2
(45) Date of Patent: Apr. 8, 2014

(54) INTEGRAL HEAT SINK AND HOUSING LIGHT EMITTING DIODE ASSEMBLY

(75) Inventor: Peter A. Hochstein, Troy, MI (US)

(73) Assignee: Relume Technologies, Inc., Oxford, MI (US)

( * ) Notice: Subject to any disclaimer, the term of this patent is extended or adjusted under 35 U.S.C. 154(b) by 260 days.

(21) Appl. No.: 12/996,560

(22) PCT Filed: Jun. 4, 2009

(86) PCT No.: PCT/US2009/046218

§ 371 (c)(1),
(2), (4) Date: Jan. 21, 2011

(87) PCT Pub. No.: WO2009/149238

PCT Pub. Date: Dec. 10, 2009

(65) Prior Publication Data

US 2011/0122616 A1 May 26, 2011

Related U.S. Application Data

(60) Provisional application No. 61/059,405, filed on Jun. 6, 2008.

(51) Int. Cl.
*F21V 19/02* (2006.01)

(52) U.S. Cl.
USPC ..... 362/235; 362/240; 313/33

(58) Field of Classification Search
USPC ..... 313/17, 20, 33, 46, 45; 362/240, 480, 362/546, 547, 218, 294, 373, 555, 235, 362/249.01, 249.02; 439/487; 257/81; 40/427–445, 541, 583, 714–716
See application file for complete search history.

(56) References Cited

U.S. PATENT DOCUMENTS

| | | | | |
|---|---|---|---|---|
| 4,352,148 | A * | 9/1982 | McJunkin et al. | 362/544 |
| 6,132,070 | A * | 10/2000 | Vosika et al. | 362/368 |
| 6,547,419 | B1 * | 4/2003 | Brackman | 362/253 |
| 6,585,395 | B2 * | 7/2003 | Luk | 362/249.02 |
| 6,793,369 | B2 * | 9/2004 | Calzaretta et al. | 362/219 |
| 7,744,237 | B2 * | 6/2010 | Potucek et al. | 362/101 |
| 7,837,374 | B2 * | 11/2010 | Hsu et al. | 362/612 |
| 8,123,381 | B1 * | 2/2012 | Wray | 362/294 |
| 2003/0156416 | A1 | 8/2003 | Stopa et al. | |
| 2005/0280683 | A1 * | 12/2005 | Custer | 347/102 |
| 2006/0012286 | A1 | 1/2006 | Cull et al. | |

(Continued)

FOREIGN PATENT DOCUMENTS

JP 2007306309 11/2007

*Primary Examiner* — Anh Mai
*Assistant Examiner* — Fatima Farokhrooz
(74) *Attorney, Agent, or Firm* — Dickinson Wright, PLLC

(57) ABSTRACT

A light assembly (20) for mounting to a planar support includes an extruded heat sink (22) presenting a mounting surface (24) and a heat transfer surface (26) slanted from an upper border (32) to a lower border (30). A panel block (52) depends from the lower border (30), a lens block (68) depends from the upper border (32), a back side (76) extends downwardly from the lens block (60), a truss member (82) interconnects the back side (76) and the heat transfer surface (26), and a mounting block (84) extends from the back side (76). The extruded heat sink (22) is cut into independent elongated sections (28) and light emitting diodes (44) are disposed thereon. The elongated sections (28) are mitered to one another to define a frame. A light directing panel (56) extends from the panel blocks (52) and a lens sheet (72) extends from the lens blocks (68).

36 Claims, 2 Drawing Sheets

(56) References Cited

U.S. PATENT DOCUMENTS

2006/0034097 A1* 2/2006 Hahm et al. ..... 362/555
2007/0285920 A1* 12/2007 Seabrook ..... 362/240
2008/0094835 A1* 4/2008 Marra et al. ..... 362/247
2008/0285260 A1* 11/2008 Sherman ..... 362/133

* cited by examiner

INTEGRAL HEAT SINK AND HOUSING LIGHT EMITTING DIODE ASSEMBLY

CROSS-REFERENCE TO RELATED APPLICATIONS

This application is a National Stage of International Application No. PCT/US2009/046218, filed Jun. 4, 2009. This application claims the benefit of U.S. Provisional Application No. 61/059,405, filed on Jun. 6, 2008. The entire disclosure of the above application is incorporated herein by reference.

BACKGROUND OF THE INVENTION

1. Field of the Invention

The subject invention relates to a light emitting assembly of the type including light emitting diodes (L.E.D.), and more particularly, light assemblies for mounting to a planar support.

2. Description of the Prior Art

Light emitting diode (L.E.D.) light assemblies use less electrical power and thus are becoming more common as L.E.D. technology continues to improve. An important factor driving this acceptance of L.E.D.s is the increasingly attractive life cycle cost of such L.E.D. light assemblies. The expected useful life of properly designed L.E.D. light assemblies can exceed 10-12 years, or 70,000 hours, compared to a nominal 2-3 year life of high-intensity discharge (H.I.D.) lamps. An example of a properly designed L.E.D. light assembly is disclosed in U.S. Pat. No. 5,857,767 to the present inventor, Peter A. Hochstein. At least a fifty percent (50%) energy savings is possible when H.I.D. light assemblies are replaced with such properly designed L.E.D. light assemblies. The energy related cost savings allow the L.E.D. light assemblies to pay for themselves in a relatively short period of time.

Recently, municipalities desire to replace their wall-mounted H.I.D. light assemblies, such as the low bay light assemblies used in parking garages, with L.E.D. light assemblies. Many existing L.E.D. light assemblies perform well under ideal operating conditions, or prior to being mounted to a planar surface or wall, but due to poor thermal management, the L.E.D. light assemblies do not perform well when mounted on a planar surface. The existing wall-mounted light assemblies typically include heat sinks enclosed in a poorly ventilated housing. Convective cooling of the light assembly is limited due to the planar wall and geometry of the housing.

Many existing low bay light assemblies include fins extending vertically from the heat sink to improve thermal management, such as the L.E.D. light assembly disclosed in the Pacific Northwest National Laboratory Report: *Demonstration Assessment of Light-Emitting Diode (LED) Area Lights for a Commercial Garage*, dated November 2008 (see page 2.4). However, when such L.E.D. light assemblies are mounted to a planar surface, the fins are disposed adjacent the planar surface or housing, and thus cannot effectively shed heat to ambient air. In such cases, a 10° C. per Watt thermal resistance is typical. The aggregate sum of all thermal resistances of the L.E.D. light assembly is then approximately 22° C. per Watt, and the junction temperature rise of a 3 Watt L.E.D. would be approximately 66° C. At ordinary ambient temperatures in the 20° C. ranges, the L.E.D. junction would be operating at about 86° C., which reduces the useful life of the L.E.D. light assembly from 70,000 hours to approximately 20,000 hours of useful life.

SUMMARY OF THE INVENTION

The invention provides for an L.E.D. light emitting assembly for mounting to a planar support. The light assembly comprises heat sink presenting a mounting surface and an oppositely facing heat transfer surface. The heat sink includes a plurality of elongated sections, which extend between a lower border and an upper border between the ends of the elongated sections. A plurality of light emitting diodes are disposed on the mounting surface of the elongated sections. The ends of the elongated sections abut one another at inwardly and downwardly slanted angles from the upper borders to the lower borders so that the mounting surfaces of the elongated sections together define a frame about an enclosed space. The heat sink includes a back side extending along and downwardly from the upper border between the ends of the elongated sections. The back side is spaced from the heat transfer surface of the elongated sections. The heat sink also includes a truss member interconnecting the back side and the adjacent heat transfer surface of the adjacent elongated section. The truss member is integral with the heat transfer surface and the back side.

The subject invention also provides a first method of fabricating an L.E.D. light assembly for mounting to a planar support. The method comprises extruding a continuous strip of a heat sink having a cross section presenting an elongated section having a section thickness between a mounting surface and a heat transfer surface slanted inwardly and downwardly from an upper border to a lower border between ends. The continuous strip of the heat sink extruded in the method of the subject invention also includes a panel block depending from the lower border, a lens block extending outwardly and upwardly from the upper border, a back side extending downwardly from and integral with the lens block, a truss member interconnecting the back side and the heat transfer surface of the elongated section, and a mounting block extending inwardly from the back side.

The subject invention provides a second method of fabricating an L.E.D. light assembly for mounting to a planar support. The second method comprises cutting a continuous strip of a heat sink having a cross section presenting an elongated section into a plurality of strips independent of one another rand each presenting the elongated section. The continuous strip of the heat sink being cut has a section thickness between a mounting surface and a heat transfer surface slanted inwardly and downwardly from an upper border to a lower border between ends. The continuous strip of the heat sink being cut also includes a panel block depending from the lower border, a lens block extending outwardly and upwardly from the upper border, a back side extending downwardly from and integral with the lens block, a truss member interconnecting the back side and the heat transfer surface of the elongated section, and a mounting block extending inwardly from the back side. The second method includes disposing light emitting diodes on the mounting surface of each elongated section. Next, the second method includes joining the ends of the elongated sections so that the elongated sections define a frame about an enclosed space.

The subject invention provides a third method of fabricating an L.E.D. light assembly. The third method comprises forming a plurality of elongated sections having a mounting surface slanted inwardly and downwardly from an upper border to a lower border between ends joined together so that the elongated sections define a frame about an enclosed space. The third method also comprises disposing light emitting diodes on the mounting surface of each elongated section.

Advantages of the Invention

The subject invention provides a properly designed L.E.D. light emitting assembly for mounting to a planar wall or support. The heat sink encloses the light emitting diodes and can be directly mounted to a planar surface, thus eliminating the need for a separate housing. Also, when the L.E.D. light assembly is mounted to a planar surface, virtually all exterior surfaces of the L.E.D. light assembly are exposed to ambient air and can be cooled by convective air currents. The exterior surfaces effectively shed heat to the ambient air, thus minimizing the temperature rise at the light emitting diodes. The L.E.D. light assembly provides a short thermal path from the light emitting diodes disposed on the mounting surface of the heat sink to the outside surfaces of the heat sink. This effective thermal management allows the L.E.D. light assembly of the subject invention to achieve an expected useful life of about 70,000 hours and at least a fifty percent energy savings, compared to high-intensity discharge (H.I.D.) light assemblies.

BRIEF DESCRIPTION OF THE DRAWINGS

Other advantages of the present invention will be readily appreciated, as the same becomes better understood by reference to the following detailed description when considered in connection with the accompanying drawings wherein.

DETAILED DESCRIPTION OF THE INVENTION

Figure 1:
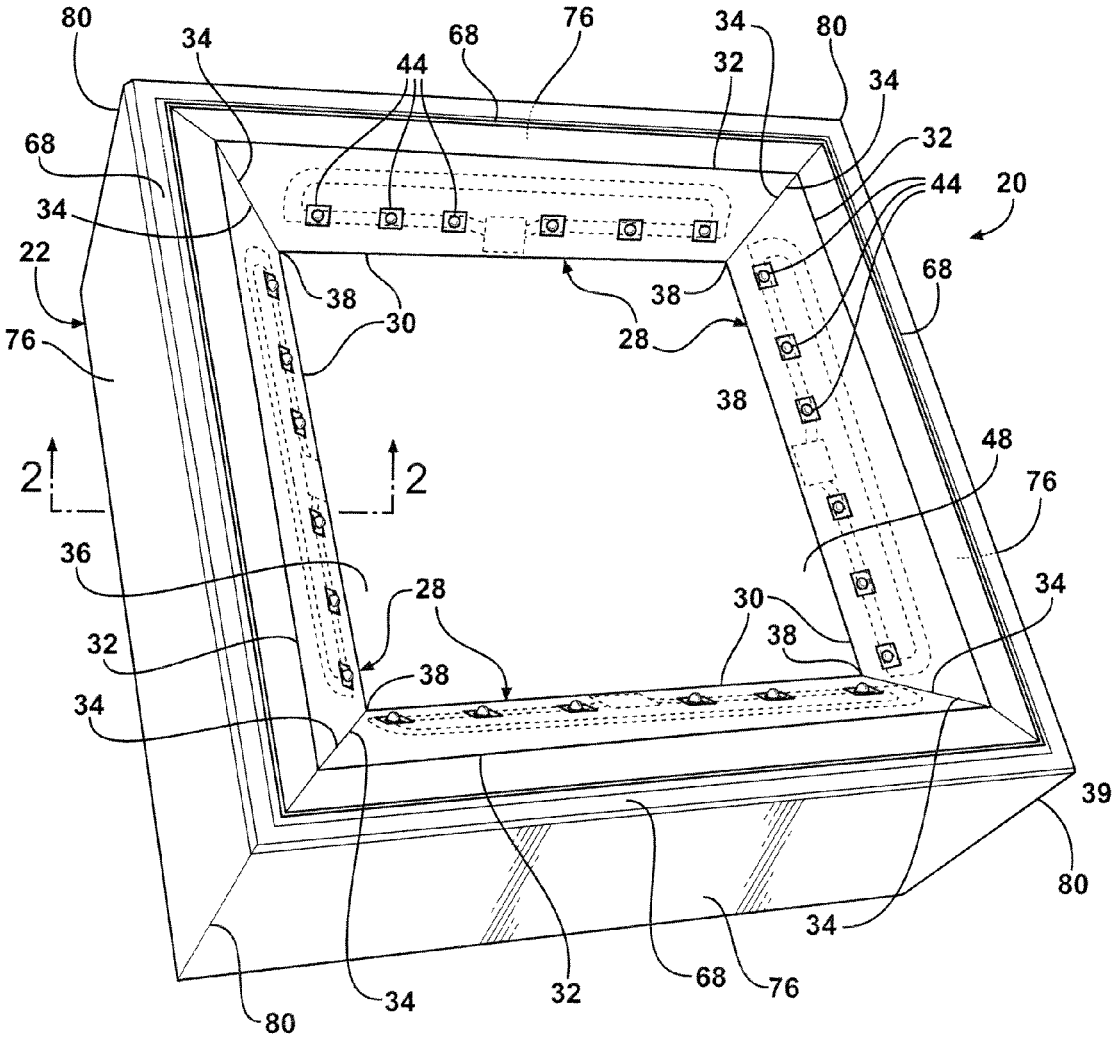
FIG. 1 is perspective view of a preferred embodiment of the subject invention wherein four of the elongated sections form a tetrahedral shape in a rectangular frame about an enclosed space.

Referring to the Figures, an L.E.D. light emitting assembly 20 for mounting to a planar support is generally shown. The L.E.D. light emitting assembly 20 includes a heat sink 22, generally indicated in FIG. 1, comprising a thermally conductive and electrically insulating material, such as a homogeneous aluminum or an aluminum alloy. The heat sink 22 is formed to present a mounting surface 24 and an oppositely facing a heat transfer surface 26, as shown in FIG. 2. The heat sink 22 is then divided into a plurality of elongated sections 28 independent of one another. The elongated sections 28 each present a section thickness t between the heat transfer surfaces 26 and the mounting surfaces 24, as shown in FIG. 2. The section thickness t extends between a lower border 30 and an upper border 32 of the elongated section 28 and linearly between ends 34. The elongated sections 28 are preferable identical in cross section, length, and width. However, the elongated sections 28 can have cross sections, lengths, and widths that differ from those shown. The elongated sections 28 are preferably formed by extrusion, but may be formed by casting, or the like.

Figure 2:
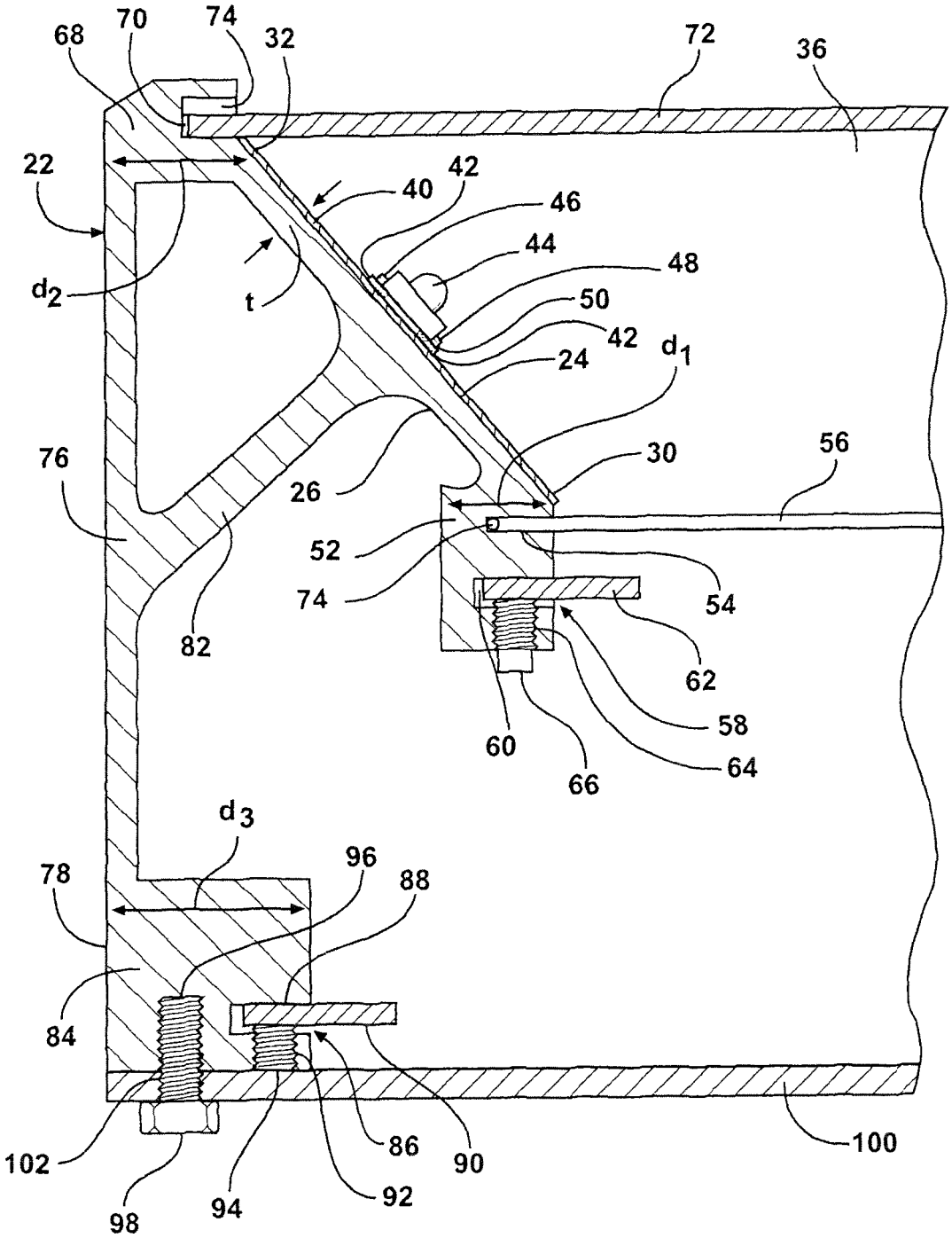
FIG. 2 is a fragmentary cross sectional view taken along line 2-2 of FIG. 1.

The ends 34 of four of the elongated sections 28 abut one another at inwardly and downwardly slanted angles from the upper borders 32 to the lower borders 30 so that the mounting surfaces 24 of the elongated sections 28 together define a frame about an enclosed space 36, as shown in FIG. 1. Typically, four of the elongated sections 28 are mitered to one another at the ends 34. In other words, the ends 34 to be joined are cut from the upper border 32 to the lower border 30 at 45° angles and then joined into a right angle to define an inside corner 38 at each mitered abutment.

The upper borders 32 are longer than the lower borders 30 so that each of the mounting surfaces 24 of the elongated sections 28 define a trapezoidal shape about the enclosed space 36, as shown in FIG. 1. Alternatively, the light assembly 20 can comprise a different number of elongated sections 28 mitered to one another about the enclosed space 36. For example, five elongated sections 28 can be mitered to one another so that each of the mounting surfaces 24 define the trapezoidal shape and together form a pentahedron shape in a pentagonal frame about the enclosed space 36.

The light assembly 20 includes a coating 40 of electrically insulating material disposed over the mounting surface 24 of the heat sink 22, as shown in FIG. 2. The coating 40 is less than one thousand microns thick, but preferably less than three hundred microns thick. The coating 40 may be continuous and cover the entire mounting surface 24 of the heat sink 22, or it may be disposed in circuitous tracks separated from one another by the bare metal of the heat sink 22.

Circuit traces 42 are disposed in spaced lengths from one another on the mounting surface 24 of the heat sink 22 to prevent electrical conduction between the traces 42. The traces 42 extend in end to end relationship along at least one of the elongated sections 28, as shown in FIG. 1. The coating 40 prevents electrical conduction from each of the traces 42 to the heat sink 22. The traces 42 may consist of a polymetric material having metal particles dispersed therein, such as an expoxy compound with a noble metal, or a phenolic resin compounded with either copper, silver, or nickel.

A plurality of light emitting diodes 44 are disposed on the mounting surface 24 to span the spaces between the ends of adjacent traces 42, as shown in FIG. 1. Each one has a positive lead 46 and a negative lead 48 being in electrical engagement with the adjacent ones of the traces 42 to electrically interconnect the traces 42 and the light emitting diodes 44. The light emitting diodes 44 are disposed in the spaces between adjacent traces 42 on each one of the elongated sections 28. An electrically conductive adhesive 50 secures the leads 46, 48 of the light emitting diodes 44 to adjacent ones of the circuit traces 42, as shown in FIG. 2. The light emitting diodes 44 on each of the elongated sections 28 may be electrically interconnected in series with one another and electrically interconnected in parallel with the ones on other elongated sections 28. The light emitting diodes 44 on each of the elongated sections 28 are shown as having a uniform space between each adjacent light emitting diode 44. However, the plurality of light emitting diodes 44 on each elongated section 28 may have non-uniform spaces between one another. The electrical components of the assembly 20 are connected with printed, foil or wire conductors.

The heat sink 22 further comprises a panel block 52 depending from and extending continuously along the lower border 30 between the ends 34 of each of the elongated sections 28. The panel block 52 is integral with the elongated section 28 and comprises the same thermally conductive and electrically insulating aluminum material. Each of the panel blocks 52 have a greater dimension $d_1$ than the section thickness t of the elongated sections 28 so that a panel slot 54 can be defined in the panel blocks 52, as shown in FIG. 2. The panel slots 54 extends transversely into and continuously along the panel blocks 52. The panel slots 54 open into the enclosed space 36 so that a light directing panel 56 can be disposed in the panel slots 54 of all of the panel blocks 52 depending from the elongated sections 28. The light directing panel 56 typically comprises a rectangular shape and extends continuously between the panel slots 54, beneath the enclosed space 36. The light directing panel 56 comprises a reflective material for reflecting light emitting from the light emitting diodes 44.

A first connection 58 extends between the panel blocks 52 at adjacent abutting ends 34 of the elongated sections 28. The first connection 58 connects adjacent panel blocks 52 at the inside corners 38 and thus holds the elongated sections 28 in place, framing the enclosed space 36. Typically, the first connection 58 includes a first connection opening 60 cut into each of the panel blocks 52 below and parallel to the panel slots 54, as shown in FIG. 2. A first connection plate 62 extends between adjacent panel blocks 52 and into the first connection openings 60 of the adjacent panel blocks 52 at each of the inside corners 38. The first connection 58 can also include a first connection screw hole 64 drilled into each of the panel blocks 52 and extending transversely into the first connection opening 60. A first connection screw 66 can extend into the first connection screw hole 64 of each of the adjacent panel blocks 52 and transversely to the first connection plate 62 for clamping the first connection plate 62 in the first connection opening 60 of each of the inside corners 38. The first connection plates 62 and first connection screws 66 typically comprise a steel material.

A lens block 68 extends outwardly and upwardly from and continuously along the upper border 32 between the ends 34 of each of the elongated sections 28. Each of the lens blocks 68 also have a greater dimension $d_2$ than the section thickness t of the elongated sections 28 so that a lens slot 70 can be defined in the lens block 68, as shown in FIG. 2. The lens slots 70 extend transversely into and continuously along the lens blocks 68. The lens slots 70 open into the enclosed space 36 so that a lens sheet 72 can be disposed in the lens slots 70 of all of the lens blocks 68 extending from the elongated sections 28. The lens sheet 72 comprises a light transmitting material for allowing light emitting from the light emitting diodes 44 and the light directing panel 56 to pass therethrough. The lens sheet 72 typically comprises a rectangular shape and extends continuously between the lens slots 70, above the enclosed space 36, so that the lens sheet 72 and light directing panel 56 together close the enclosed space 36. An adhesive seal 74 can be disposed in the panel slots 54 and the lens slots 70 to secure the light directing panel 56 in the panel slots 54 and the lens sheet 72 in the lens slots 70.

The heat sink 22 further comprises a back side 76 extending downwardly from each of the lens blocks 68 to a lower side edge 78 disposed below the panel block 52, as shown in FIG. 2. The back sides 76 are integral with the lens blocks 68 and comprise the same aluminum material. The back sides 76 typically comprise a rectangular shape and are disposed in abutting relationship to one another to define outside corners 80 spaced outwardly from the mitered ends 34 of the elongated sections 28.

Preferably, the heat sink 22 includes a truss member 82 interconnecting each of the back sides 76 and the heat transfer surface 26 of the adjacent elongated section 28, as shown in FIG. 2. The truss member 82 extends continuously between the outside corners 80 of each of the back sides 76 to provide support to the elongated sections 28 and back side 76, and to transfer heat from the heat transfer surface 26 to the back side 76. The truss member 82 typically extends from the center of the back side 76 to the center of the heat transfer surface 26 to define a slot extending continuously and longitudinally between the corresponding back side 76 and heat transfer surface 26 and lens block 68.

The heat sink 22 also includes a mounting block 84 extending inwardly from the lower side edge 78 of each of the back sides 76 and spaced below and outwardly from the corresponding panel block 52, so that there is a space between the light directing panel 56 and the mounting blocks 84, as shown in FIG. 2. The mounting blocks 84 are integral with the back sides 76 and comprise the same aluminum material. The mounting blocks 84 extend continuously along the lower side edges 78 between the outside corners 80 of each of the back sides 76. The mounting blocks 84 also have a greater dimension $d_3$ than the section thickness t of the elongated sections 28 for accommodating a second connection 86, as shown in FIG. 2.

The second connection 86 extends between the mounting blocks 84 at adjacent outside corners 80 of the light assembly 20. The second connection 86 connects adjacent mounting blocks 84 at the outside corners 80 and holds the elongated sections 28 in place, framing the enclosed space 36. Typically, the second connection 86 includes a second connection opening 88 cut in each of the mounting blocks 84 and opening into the enclosed space 36. A second connection plate 90 extends between adjacent mounting blocks 84 and into the second connection openings 88 of the adjacent mounting blocks 84 at each of the outside corners 80. The second connection 86 can also include a second connection screw hole 92 drilled into each of the mounting blocks 84 and extending transversely into the panel slots 54. A second connection screw 94 can be disposed in the second connection screw hole 92 of each of the adjacent mounting blocks 84. The second connection screw 94 extends transversely to the second connection plate 90 for clamping the second connection plate 90 in the second connection opening 88 at each of the outside corners 80. The second connection plates 90 and second connection screws 94 typically comprise a steel material. Each of the mounting blocks 84 can also define at least one cover screw hole 96 drilled into the mounting block 84 for receiving a cover screw 98.

A protective cover 100 can be disposed on the mounting blocks 84 for sealing the space below the light directing panel 56 and closing the light assembly 20, as shown in FIG. 2. The protective cover 100 typically comprises a rectangular shape and extends continuously between the mounting blocks 84. A plurality of cover slots 102 can be defined in the protective cover 100, each one aligning with one of the cover screw holes 96 in the mounting blocks 84. A cover screw 98 extends through each of the cover slots 102 and into the corresponding cover screw hole 96 for securing the protective cover 100 to the mounting blocks 84. The protective cover 100 typically comprises a durable metal material, and the cover screws 98 typically comprise a steel material.

A mounting bracket can be directly attached to the heat sink 22 or to the protective cover 100 for mounting the light assembly 20 to a planar support, such as a wall or ceiling. The light assembly 20 can be mounted so that the protective cover 100 is disposed along the wall or ceiling and so that the back sides 76 and lens hocks 68 are exposed to ambient air. The heat sink 22, especially the back sides 76, which forms the outer surface of the light assembly 20, can be cooled by convective air currents, thus minimizing the temperature rise at the light emitting diodes 44. As alluded to above, the careful design of the heat sink 22 eliminates the need for a separate housing. The heat sinks 22, especially the lens blocks 68 and the back sides 76, shield the mounting surfaces 24 of the elongated sections 28 and the light emitting diodes 44 thereon from precipitation, debris, and other harmful effects that would be detrimental to the light assembly's 20 operation.

The subject invention also includes a method of manufacturing the light emitting assembly 20 for mounting to a planar support. As alluded to above, the method preferably includes extruding a continuous strip of the heat sink 22 having a cross section presenting the elongated section 28, panel block 52, lens block 68, back side 76, truss member 82, and mounting block 84. The continuous strip of heat sink 22 is extruded so that the elongated section 28 has the section thickness t between the mounting surface 24 and the heat transfer surface 26 and is slanted inwardly and downwardly from the upper border 32 to the lower border 30. The continuous strip of the heat sink 22 is also extruded so that the panel block 52 depends from the lower border 30 and includes the panel slot 54 and the first connection opening 60. The continuous strip of heat sink 22 is extruded so that the lens block 68 extends outwardly and upwardly from the upper border 32 and includes the lens slot 70. The continuous strip of heat sink 22 is extruded so that the back side 76 extends downwardly from the lens block 68 and the truss member 82 interconnects the back side 76 and the heat transfer surface 26 of the elongated section 28. The continuous strip of heat sink 22 is extruded so that the mounting block 84 extends inwardly from the lower side edge 78 of the back side 76 and includes the second connection openings 88 spaced from one another in the mounting block 84. The continuous strip of heat sink 22 is also extruded so that the panel block 52, lens block 68, and mounting block 84 each have a greater dimension d than the section thickness t.

Next, the method comprises cutting the continuous strip of the heat sink 22 into a plurality of independent strips. Each of the strips comprises an identical cross section and presents the elongated section 28. The plurality of light emitting diodes 44 and corresponding electrical components, as describe above, are disposed on the mounting surface 24 of each elongated section 28.

The method includes mitering each of the ends 34 of one elongated section 28 to the end 34 of another elongated section 28 so that the three elongated sections 28 collectively define a U-shape. Specifically, the mitering comprises cutting the ends 34 of the elongated sections 28 from the upper borders 32 to the lower borders 30 at 45° angles and joining the elongated sections 28 at right angles to form a miter joint.

Next, the method comprises sliding the light directing panel 56 into the panel slots 54 of all of the panel blocks 52 depending from the three mitered elongated sections 28, and sliding a lens sheet 72 into the lens slots 70 of all of the lens blocks 68 depending from the three mitered elongated sections 28. The adjacent panel blocks 52 are then interconnected at the adjacent abutting ends 34 of the three mitered elongated sections 28.

The interconnecting of the adjacent panel blocks 52 at the adjacent abutting ends 34 can comprise inserting a first connection plate 62 into each of the first connection openings 60 of the adjacent panel blocks 52 and clamping the first connection plates 62 in the first connection openings 60. The clamping of the first connection plates 62 can be further defined as inserting a first connection screw 66 into each of the mounting blocks 84 and engaging the first connection plate 62 with the first connection screw 66.

After the panel blocks 52 associated with the three mitered elongated sections 28 are interconnected, the method includes joining a forth elongated section 28 to the open ends 34 of the U-shape of the three mitered elongated sections 28 so that the four mitered elongated sections 28 define a tetrahedral frame about the enclosed space 36. The adjacent panel blocks 52 at the adjacent abutting ends 34 associated with the forth mitered elongated section 28 are then interconnected.

Next, the method comprises interconnecting the adjacent mounting blocks 84 at the adjacent outside corners 80 of the back sides 76 depending from the four mitered elongated sections 28. The interconnecting of the adjacent mounting blocks 84 can comprise inserting a second connection plate 90 into each of the second connection openings 88 of the adjacent mounting blocks 84 and clamping the second connection plates 90 in the second connection openings 88. The clamping of the first connection plates 62 can be further defined as inserting a second connection screw 94 into each of the mounting blocks 84 and engaging the second connection plate 90 with the second connection screw 94.

The method can include fabricating a protective cover 100 having cover slots 102, and closing the light assembly 20 by extending the protective cover 100 continuously between all of the mounting blocks 84. Finally, the method includes securing the protective cover 100 to each of the mounting blocks 84 by inserting cover screws 98 through the cover slots 102 in the protective cover 100 and into the mounting blocks 84.

The total method including the extruding, cutting, and joining, as described above, can be broken down into independent methods or sub-methods. The first independent method comprises extruding the continuous strip of the heat sink 22. The second independent comprises cutting the continuous strip of the heat sink 22. In other words, cutting the continuous strip of the heat sink 22 can be performed separate from extruding the continuous strip of the heat sink 22. The third independent method comprises forming the plurality of elongated sections 28, disposing the light emitting diodes 44 thereon, and joining the ends 34 of the elongated sections 28.

Obviously, many modifications and variations of the present invention are possible in light of the above teachings and may be practiced otherwise than as specifically described while within the scope of the appended claims. The use of the word "said" in the apparatus claims refers to an antecedent that is a positive recitation meant to be included in the coverage of the claims whereas the word "the" precedes a word not meant to be included in the coverage of the claims. In addition, the reference numerals in the claims are merely for convenience and are not to be read in any way as limiting.

What is claimed is:

1. An L.E.D. light emitting assembly (20) for mounting to a planar support comprising:

a heat sink (22) presenting a mounting surface (24), said heat sink (22) including a plurality of elongated sections (28) extending between a lower border (30) and an upper border (32) between ends (34), a plurality of light emitting diodes (44) disposed on said mounting surface (24), said ends (34) of said elongated sections (28) abutting one another at inwardly and downwardly slanted angles from said upper borders (32) to said lower borders (30) so that said mounting surfaces (24) of said elongated sections (28) together define a frame about an enclosed space (36), said heat sink (22) defining a panel slot (54) adjacent said lower border (30) of each of said elongated sections (28) and opening into said enclosed space (36) and a lens slot (70) adjacent said upper border (32) of each of said elongated sections (28) and opening into said enclosed space (36), a light directing panel (56) disposed in said panel slots (54), a lens sheet (72) disposed in said lens slots (70), and a seal (74) disposed in said panel slots (54) and said lens slots (70) for sealing said light directing panel (56) in said panel slots (54) and said lens sheet (72) in said lens slots (70).

2. An L.E.D. light emitting assembly (20) as set forth in claim 1 wherein said heat sink (22) presents a heat transfer surface (26) facing opposite said mounting surface (24), and said elongated sections (28) present a section thickness (t) between said mounting surface (24) and said heat transfer surface (26) extending between said lower border (30) and said upper border (32).

3. An L.E.D. light emitting assembly (20) as set forth in claim 1 wherein said abutting ends (34) of said elongated sections (28) define an inside corner (38) at each abutment with said upper border (32) being longer than said lower border (30) so that each of said mounting surfaces (24) of said elongated sections (28) define a trapezoidal shape.

4. An L.E.D. light emitting assembly (20) as set forth in claim 1 wherein said elongated sections (34) are independent of one another and said abutting ends (34) of said elongated sections (28) are mitered to define an inside corner (38) at each mitered abutment with said upper border (32) being longer than said lower border (30) so that each of said mounting surfaces (24) of said elongated sections (28) define a trapezoidal shape.

5. An L.E.D. light emitting assembly (20) as set forth in claim 1 wherein said heat sink (22) is a cast.

6. An L.E.D. light emitting assembly (20) as set forth in claim 1 wherein said heat sink (22) presents a heat transfer surface (26) facing opposite said mounting surface (24), said heat sink (22) includes a back side (76) extending along and downwardly from said upper border (32) between said ends (34) of said elongated sections (28) and spaced from said heat transfer surface (26) of said elongated sections (28), said heat sink (22) includes a truss member (82) interconnecting said back side (76) and the adjacent heat transfer surface (26) of the adjacent elongated section (28), and said truss member (82) is integral with said heat transfer surface (26) and said back side (76).

7. An L.E.D. light emitting assembly (20) as set forth in claim 1 wherein said seal (74) is an adhesive for securing said light directing panel (56) in said panel slots (54) and said lens sheet (72) in said lens slots (70).

8. An L.E.D. light emitting assembly (20) as set forth in claim 2 including a panel block (52) depending from and extending along said lower border (30) between said ends (34) of said elongated sections (28), and wherein said panel block (52) includes said panel slot (54).

9. An L.E.D. light emitting assembly (20) as set forth in claim 2 including a lens block (68) depending from and extending along said upper border (32) between said ends (34) of said elongated sections (28), and wherein said lens block (68) includes said lens slot (70).

10. An L.E.D. light emitting assembly (20) as set forth in claim 9 wherein said lens block (68) has a greater dimension ($d_2$) than said section thickness (t) and said lens slot (70) extends transversely into said lens block (68) and said lens sheet (72) extends transversely from said lens slots (70) of said lens blocks (68).

11. An L.E.D. light emitting assembly (20) as set forth in claim 9 wherein said heat sink (22) includes a back side (76) extending downwardly from said lens block (68).

12. An L.E.D. light emitting assembly (20) as set forth in claim 8 wherein said panel block (52) has a greater dimension ($d_1$) than said section thickness (t) and said panel slot (54) extends transversely into said panel block (52) and said light directing panel (56) extends transversely from said panel slots (54) of said panel blocks (52).

13. An L.E.D. light emitting assembly (20) as set forth in claim 8 including a first connection (58) extending between said panel blocks (52) at adjacent abutting ends (34) of said elongated sections (28) for connecting adjacent panel blocks (52).

14. An L.E.D. light emitting assembly (20) as set forth in claim 11 including a mounting block (84) extending from an end of said back side (76) opposite said lens block (68).

15. An L.E.D. light emitting assembly (20) as set forth in claim 14 wherein said mounting block (84) has a greater dimension ($d_3$) than said section thickness (t) and defines a cover screw hole (96) extending into said mounting block (84) for receiving a cover screw (98) and including a protective cover (100) disposed on and extending between said mounting blocks (84) of said elongated sections (28) for closing said light assembly (20) and a plurality of cover screws (98) extending through said protective cover (100) and into the corresponding cover screw hole (96) for securing said protective cover (100) to said mounting blocks (84).

16. An L.E.D. light emitting assembly (20) as set forth in claim 14 including a second connection (86) extending between said mounting blocks (84) at adjacent abutting ends (34) of said elongated sections (28) for connecting adjacent mounting blocks (84).

17. An L.E.D. light emitting assembly (20) as set forth in claim 3 wherein said elongated sections (28) comprise four elongated sections (28) so that said mounting surfaces (24) of said elongated sections (28) together form a tetrahedral shape in said frame about said enclosed space (36).

18. An L.E.D. light emitting assembly (20) as set forth in claim 1 wherein said lower borders (30) of said elongated sections (28) together define an opening, and the lower border (30) of each elongated section (28) is spaced from another one of said lower borders (30) by said opening.

19. An L.E.D. light emitting assembly (20) for mounting to a planar support comprising:

a heat sink (22) of thermally conductive and electrically insulating aluminum material presenting a mounting surface (24) and a heat transfer surface (26) facing in the opposite direction from said mounting surface (24), said heat sink (22) including a plurality of elongated sections (28) being identical in cross section and presenting a section thickness (t) between said heat transfer surfaces (26) and said mounting surfaces (24) extending between a lower border (30) and an upper border (32) and linearly between ends (34), a coating (40) of electrically insulating material disposed over said mounting surface (24) of said elongated sections (28), said coating (40) being less than one thousand microns in thickness, a plurality of circuit traces (42) spaced from one another on said coating (40) for preventing electrical conduction between said circuit traces (42) so that said coating (40) prevents electrical conduction from each of said circuit traces (42) to said heat sink (22), a plurality of light emitting diodes (44) disposed in spaces between adjacent ones of said circuit traces (42), each of said light emitting diodes (44) having a positive lead (46) and a negative lead (48), said leads (46, 48) of each of said light emitting diodes (44) being in electrical engagement with said adjacent ones of said circuit traces (42) for electrically interconnecting said circuit traces (42) and said light emitting diodes (44), an adhesive (50) of electrically conductive material securing said leads (46, 48) to said circuit traces (42), said light emitting diodes (44) on each of said elongated sections (28) being electrically interconnected in series with one another, said light emitting diodes (44) on each of said elongated sections (28) being electrically interconnected in parallel with said light emitting diodes (44) on other elongated sections (28), characterized by said ends (34) of four of said elongated sections (28) abutting one another at inwardly and downwardly slanted angles from upper borders (32) to lower borders (30) to define an inside corner (38) at each abutment with said upper border (32) being longer than said lower border (30) so that each of said mounting surfaces (24) of said elongated sections (28) define a trapezoidal shape and together form a tetrahedral shape in a rectangular frame about an enclosed space (36), a panel block (52) having a greater dimension ($d_1$) than said section thickness (t) and depending from and extending continuously along said lower border (30) between said ends (34) of each of said elongated sections (28), each of said panel blocks (52) defining a panel slot (54) extending transversely into and continuously along said panel block (52) and opening into said enclosed space (36), a light directing panel (56) comprising a rectangular shape disposed in and extending transversely from and continuously between said panel slots (54) of all of said panel blocks (52), said light directing panel (56) comprising a reflective material for reflecting light emitting from said light emitting diodes (44), a lens block (68) having a greater dimension ($d_2$) than said section thickness (t) and extending outwardly and upwardly from and continuously along said upper border (32) between said ends (34) of each of said elongated sections (28), each of said lens blocks (68) defining a lens slot (70) extending transversely into and continuously along said lens block (68) and opening into said enclosed space (36), a lens sheet (72) comprising a rectangular shape disposed in and extending transversely from and continuously between said lens slots (70) of all of said lens blocks (68), said lens sheet (72) comprising a light transmitting material for allowing light emitting from said light emitting diodes (44) and said light directing panel (56) to pass therethrough, an adhesive seal (74) disposed in said panel slots (54) and said lens slots (70) securing said light directing panel (56) in said panel slots (54) and said lens sheet (72) in said lens slots (70), a back side (76) extending downwardly from and integral with each of said lens blocks (68) to a lower side edge (78) disposed below said panel block (52), each of said back sides (76) comprising a rectangular shape and disposed in abutting relationship to one another to define outside corners (80) spaced outwardly from said ends (34) of said elongated sections (28), a truss member (82) interconnecting each of said back sides (76) and the adjacent heat transfer surface (26) of the adjacent elongated section (28) and extending continuously between said outside corners (80) of each of said back sides (76), a mounting block (84) having a greater dimension ($d_3$) than said section thickness (t) and extending inwardly from said lower side edge (78) of each of said back sides (76) and spaced below and outwardly from the corresponding panel block (52), each of said mounting blocks (84) extending continuously along said lower side edge (78) between said outside corners (80) of each of said back sides (76), a protective cover (100) disposed on and extending continuously between all of said mounting blocks (84) for closing the light assembly (20), said protective cover (100) defining a plurality of cover slots (102) each one aligning with one of said cover screw holes (96) in said mounting blocks (84), and a cover screw (98) extending through each of said cover slots (102) and into the corresponding cover screw hole (96) for securing said protective cover (100) to said mounting blocks (84).

20. A method of fabricating an L.E.D. light emitting assembly (20) comprising:

extruding a continuous strip of a heat sink (22) having a cross section presenting an elongated section (28) having a section thickness (t) between a mounting surface (24) and a heat transfer surface (26) slanted inwardly and downwardly from an upper border (32) to a lower border (30) between ends (34) and a panel block (52) depending from the lower border (30) and a panel slot 54 extending transversely into and continuously along the panel block 52 adjacent the mounting surface (24) and a plurality of first connection openings (60) spaced from one another in the panel block (52) below and parallel to the panel slot (54) and a lens block (68) extending outwardly and upwardly from the upper border (32) and a back side (76) extending downwardly from and integral with the lens block (68) and a truss member (82) integrally interconnecting the back side (76) and the heat transfer surface (26) of the elongated section (28) and a mounting block (84) extending inwardly from the back side (76).

21. A method as set forth in claim 20 further comprising:

cutting the continuous strip of heat sink (22) into a plurality of strips independent of one another and each presenting the elongated section (28), disposing light emitting diodes (44) on the mounting surface (24) of each elongated section (28), and joining the ends (34) of the elongated sections (28) so that the elongated sections (28) define a frame about an enclosed space (36).

22. A method as set forth in claim 21 wherein said joining is further defined as mitering each of the ends (34) of the elongated sections (28) and abutting the mitered ends (34) of the elongated sections (28).

23. A method of fabricating an L.E.D. light emitting assembly (20) comprising:

extruding a continuous strip of a heat sink (22) having a cross section presenting an elongated section (28) having a section thickness (t) between a mounting surface (24) and a heat transfer surface (26) slanted inwardly and downwardly from an upper border (32) to a lower border (30) between ends (34) and a panel block (52) depending from the lower border (30) and a lens block (68) extending outwardly and upwardly from the upper border (32) and a back side (76) extending downwardly from and integral with the lens block (68) and a truss member (82) integrally interconnecting the back side (76) and the heat transfer surface (26) of the elongated section (28) and a mounting block (84) extending inwardly from the back side (76), cutting the continuous strip of heat sink (22) into a plurality of strips independent of one another and each presenting the elongated section (28), disposing light emitting diodes (44) on the mounting surface (24) of each elongated section (28), joining the ends (34) of the elongated sections (28) so that the elongated sections (28) define a frame about an enclosed space (36), said joining is further defined as mitering each of the ends (34) of the elongated sections (28) and abutting the mitered ends (34) of the elongated sections (28), disposing a light directing panel (56) in panel slots (54) of the panel blocks (52) depending from three abutting elongated sections (28), and disposing a lens sheet (72) in lens slots (70) of the lens blocks (68) depending from the three abutting elongated sections (28).

24. A method as set forth in claim 23 wherein said joining the ends (34) of the elongated sections (28) is further defined as abutting the ends (34) of the three elongated sections (28) to collectively define a U-shape prior to disposing the light directing panel (56) in the panel slots (54) and lens sheet (72) in the lens slots (70) and joining a forth elongated section (28) to the open ends (34) of the U-shape of the three abutting elongated sections (28) upon disposing the light directing panel (56) in the panel slots (54) and lens sheet (72) in the lens slots (70).

25. A method of fabricating an L.E.D. light assembly (20) comprising the steps of:

cutting a continuous strip of a heat sink (22) having a cross section presenting an elongated section (28) having a section thickness (t) between a mounting surface (24) and a heat transfer surface (26) slanted inwardly and downwardly from an upper border (32) to a lower border (30) between ends (34) and a panel block (52) depending from the lower border (30) and a panel slot (54) extending transversely into and continuously along the panel block (52) adjacent the mounting surface (24) and a plurality of first connection openings (60) spaced from one another in the panel block (52) below and parallel to the panel slot (54) and a lens block (68) extending outwardly and upwardly from the upper border (32) and a back side (76) extending downwardly from and integral with the lens block (68) and a truss member (82) interconnecting the back side (76) and the heat transfer surface (26) of the elongated section (28) and a mounting block (84) extending inwardly from the back side (76) into a plurality of strips independent of one another and each presenting the elongated section (28), disposing light emitting diodes (44) on the mounting surface (24) of each elongated section (28), and joining the ends (34) of the elongated sections (28) so that the elongated sections (28) define a frame about an enclosed space (36).

26. A method as set forth in claim 25 wherein the lower borders (30) of the elongated sections (28) together define an opening, and the lower border (30) of each elongated section (28) is spaced from another one of the lower borders (30) by the opening.

27. A method of fabricating an L.E.D. light assembly (20) comprising the steps of:

forming a heat sink (22) including a plurality of elongated sections (28) having a mounting surface (24) slanted inwardly and downwardly from an upper border (32) to a lower border (30) between ends (34) joined together so that the elongated sections (28) define a frame about an enclosed space (36) and a panel slot (54) adjacent the lower border (30) of each of the elongated sections (28) and opening into the enclosed space (36) and a lens slot (70) adjacent the upper border (32) of each of the elongated sections (28) and opening into the enclosed space (36), disposing light emitting diodes (44) on the mounting surface (24) of each elongated section (28), disposing a light directing panel (56) in the panel slot (54), disposing a lens sheet (72) in the lens slot (70), and disposing a seal (74) in the panel slot (54) and the lens slot (70) to seal the light directing panel.

28. A method as set forth in claim 27 wherein said forming the plurality of elongated sections (28) includes casting.

29. A method as set forth in claim 27 wherein the heat sink (22) includes a heat transfer surface (26) facing opposite the mounting surface (24) and a back side (76) extending along and downwardly from the upper border (32) between the ends (34) of the elongated sections (28) and spaced from the heat transfer surface (26) and a truss member (82) interconnecting and integral with the back side (76) and the adjacent heat transfer surface (26) of the adjacent elongated section (28).

30. A method as set forth in claim 27 wherein the seal (75) is an adhesive for securing the light directing panel (56) in the panel slots (54) and the lens sheet (72) in the lens slots (70).

31. A method of fabricating an L.E.D. light emitting assembly (20) comprising:

extruding a continuous strip of a heat sink (22) having a cross section presenting an elongated section (28) having a section thickness (t) between a mounting surface (24) and a heat transfer surface (26) slanted inwardly and downwardly from an upper border (32) to a lower border (30) and a panel block (52) having a greater dimension (dj) than the section thickness (t) and depending from the lower border (30) and a panel slot (54) extending transversely into and continuously along the panel block (52) adjacent the mounting surface (24) and a plurality of first connection openings (60) spaced from one another in the panel block (52) below and parallel to the panel slot (54) and a lens block (68) having a greater dimension (d2) than the section thickness (t) extending outwardly and upwardly from the upper border (32) and a lens slot (70) extending transversely into and continuously along the lens block (68) parallel to the panel slot (54) and a back side (76) extending downwardly from and integral with the lens block (68) to a lower side edge (78) disposed below the panel block (52) and a truss member (82) interconnecting the back side (76) and the heat transfer surface (26) of the elongated section (28) and a mounting block (84) extending inwardly from a lower side edge (78) of the back side (76) and spaced below and outwardly from the panel block (52) and a plurality of second connection openings (88) spaced from one another in the mounting block (84) and each extending parallel to one of the first connection openings (60).

32. A method as set forth in claim 31 further comprising:

cutting the continuous strip of the heat sink (22) into a plurality of strips independent of one another and each presenting the elongated section (28), disposing light emitting diodes (44) on the mounting surface (24) of each of the elongated sections (28), mitering each of the ends (34) of one elongated section (28) to the end (34) of another elongated section (28) so that the three elongated sections (28) collectively define a U-shape, sliding a light directing panel (56) into the panel slots (54) of all of the panel blocks (52) depending from the three mitered elongated sections (28), sliding a lens sheet (72) into the lens slots (70) of all of the lens blocks (68) depending from the three mitered elongated sections (28), interconnecting adjacent panel blocks (52) at adjacent abutting ends (34) of the three mitered elongated sections (28), joining a forth elongated section (28) to the open ends (34) of the U-shape of the three mitered elongated sections (28) so that the four mitered elongated sections (28) define a tetrahedral frame about an enclosed space (36), interconnecting adjacent panel blocks (52) at adjacent abutting ends (34) associated with the forth mitered elongated section (28), said interconnecting adjacent panel blocks (52) at adjacent abutting ends (34) being further defined as inserting a first connection plate (62) into each of the first connection openings (60) of the adjacent panel blocks (52) and clamping the first connection plates (62) in the first connection openings (60), said clamping the first connection plates (62) being further defined as inserting a first connection screw (66) into each of the mounting blocks (84) and engaging the first connection plate (62) with the first connection screw (66), interconnecting adjacent mounting blocks (84) at adjacent outside corners (80) of the back sides (76) depending from the four mitered elongated sections (28), said interconnecting adjacent mounting blocks (84) being further defined as inserting a second connection plate (90) into each of the second connection openings (88) of the adjacent mounting blocks (84) and clamping the second connection plates (90) in the second connection openings (88), said clamping the second connection plates (90) being further defined as inserting a second connection screw (94) into each of the mounting blocks (84) and engaging the second connection plate (90) with the second connection screw (94), fabricating a protective cover (100) having cover slots (102), closing the light assembly (20) by extending the protective cover (100) continuously between all of the mounting blocks (84), securing the protective cover (100) to each of the mounting blocks (84), and said securing the protective cover (100) being further defined as inserting cover screws (98) through the cover slots (102) in the protective cover (100) and into the mounting blocks (84).

33. A method of fabricating an L.E.D. light emitting assembly (20) comprising:

cutting a continuous strip of a heat sink (22) having a cross section presenting an elongated section (28) having a section thickness (t) between a mounting surface (24) and a heat transfer surface (26) slanted inwardly and downwardly from an upper border (32) to a lower border (30) and a panel block (52) having a greater dimension (di) than the section thickness (t) and depending from the lower border (30) and a panel slot (54) extending transversely into and continuously along the panel block (52) adjacent the mounting surface (24) and a plurality of first connection openings (60) spaced from one another in the panel block (52) below and parallel to the panel slot (54) and a lens block (68) having a greater dimension ($d_2$) than the section thickness (t) extending outwardly and upwardly from the upper border (32) and a lens slot (70) extending transversely into and continuously along the lens block (68) parallel to the panel slot (54) and a back side (76) extending downwardly from and integral with the lens block (68) to a lower side edge (78) disposed below the panel block (52) and a truss member (82) interconnecting the back side (76) and the heat transfer surface (26) of the elongated section (28) and a mounting block (84) extending inwardly from a lower side edge (78) of the back side (76) and spaced below and outwardly from the panel block (52) and a plurality of second connection openings (88) spaced from one another in the mounting block (84) and each extending parallel to one of the first connection openings (60) into a plurality of strips independent of one another and each presenting an elongated section (28), disposing light emitting diodes (44) on the mounting surface (24) of each of the elongated sections (28), mitering each of the ends (34) of one elongated section (28) to the end (34) of another elongated section (28) so that the three elongated sections (28) collectively define a U-shape, sliding a light directing panel (56) into the panel slots (54) of all of the panel blocks (52) depending from the three mitered elongated sections (28), sliding a lens sheet (72) into the lens slots (70) of all of the lens blocks (68) depending from the three mitered elongated sections (28), interconnecting adjacent panel blocks (52) at adjacent abutting ends (34) of the three mitered elongated sections (28), joining a forth elongated section (28) to the open ends (34) of the U-shape of the three mitered elongated sections (28) so that the four mitered elongated sections (28) define a tetrahedral frame about an enclosed space (36), interconnecting adjacent panel blocks (52) at adjacent abutting ends (34) associated with the forth mitered elongated section (28), said interconnecting adjacent panel blocks (52) at adjacent abutting ends (34) being further defined as inserting a first connection plate (62) into each of the first connection openings (60) of the adjacent panel blocks (52) and clamping the first connection plates (62) in the first connection openings (60), said clamping the first connection plates (62) being further defined as inserting a first connection screw (66) into each of the mounting blocks (84) and engaging the first connection plate (62) with the first connection screw (66), interconnecting adjacent mounting blocks (84) at adjacent outside corners (80) of the back sides (76) depending from the four mitered elongated sections (28), said interconnecting adjacent mounting blocks (84) being further defined as inserting a second connection plate (90) into each of the second connection openings (88) of the adjacent mounting blocks (84) and clamping the second connection plates (90) in the second connection openings (88), said clamping the second connection plates (90) being further defined as inserting a second connection screw (94) into each of the mounting blocks (84) and engaging the second connection plate (90) with the second connection screw (94), closing the light assembly (20) by extending a protective cover (100) continuously between all of the mounting blocks (84), securing the protective cover (100) to each of the mounting blocks (84), and said securing the protective cover (100) being further defined as inserting cover screws (98) through the protective cover (100) and into the mounting blocks (84).

34. An L.E.D. light emitting assembly (20) for mounting to a planar support comprising:

a heat sink (22) presenting a mounting surface (24), said heat sink (22) including a plurality of elongated sections (28) extending between a lower border (30) and an upper border (32) between ends (34), a plurality of light emitting diodes (44) disposed on said mounting surface (24), said ends (34) of said elongated sections (28) abutting one another at inwardly and downwardly slanted angles from said upper borders (32) to said lower borders (30) so that said mounting surfaces (24) of said elongated sections (28) together define a frame about an enclosed space (36), and said heat sink (22) including a panel block (52) depending from said lower border (30) and a panel slot (54) extending transversely into and continuously along said panel block (52) adjacent said mounting surface (24) and a plurality of first connection openings (60) spaced from one another in said panel block (52) below and parallel to said panel slot (54).

35. A method of fabricating an L.E.D. light assembly (20) comprising the steps of:

forming a heat sink (22) including a plurality of elongated sections (28) having a mounting surface (24) slanted inwardly and downwardly from an upper border (32) to a lower border (30) between ends (34) joined together so that the elongated sections (28) define a frame about an enclosed space (36) and a panel block (52) depending from the lower border (30) and a panel slot (54) extending transversely into and continuously along the panel block (52) adjacent the mounting surface (24) and a plurality of first connection openings (60) spaced from one another in the panel block (52) below and parallel to the panel slot (54), and disposing light emitting diodes (44) on the mounting surface (24) of each elongated section (28).

36. A method of fabricating an L.E.D. light emitting assembly (20) comprising:

extruding a continuous strip of a heat sink (22) having a cross section presenting an elongated section (28) having a mounting surface (24) slanted inwardly and downwardly from an upper border (32) to a lower border (30) between ends (34) and a panel block (52) depending from the lower border (30) and a panel slot (54) extending along the panel block (52), cutting the continuous strip of heat sink (22) into a plurality of strips independent of one another and each presenting the elongated section (28), disposing light emitting diodes (44) on the mounting surface (24) of each elongated section (28), abutting the ends (34) of three elongated sections (28) to collectively define a U-shape; and disposing a light directing panel (56) in the panel slots (54) of the panel blocks (52) depending from the three abutting elongated sections (28).

* * * * *